US006835283B2

(12) United States Patent
Weigant et al.

(10) Patent No.: US 6,835,283 B2
(45) Date of Patent: Dec. 28, 2004

(54) PROCESS AND DEVICE FOR MEASURING AND CONTROLLING THE NIP PRESSURE IN THE PRESS OF A PAPER MACHINE

(75) Inventors: Harald Weigant, Graz (AT); Harald Michels, Graz-Stattegg (AT); Simone Koidl, Graz (AT)

(73) Assignee: Andritz AG, Graz (AT)

( * ) Notice: Subject to any disclaimer, the term of this patent is extended or adjusted under 35 U.S.C. 154(b) by 30 days.

(21) Appl. No.: 10/320,052

(22) Filed: Dec. 16, 2002

(65) Prior Publication Data

US 2003/0127211 A1 Jul. 10, 2003

(30) Foreign Application Priority Data

Dec. 17, 2001 (AT) ..... A 1969/2001

(51) Int. Cl.[7] ..... D21F 3/06

(52) U.S. Cl. ..... 162/198; 162/205; 162/252; 162/263; 162/358.3

(58) Field of Search ..... 162/205, 206, 162/198, 199, 252, 253, 254, 262, 263, 358.1, 358.3, 361, DIG. 10; 100/35, 47, 50, 99, 153, 162 B, 170, 176; 73/862.55; 492/7, 10, 20; 700/127–129

(56) References Cited

U.S. PATENT DOCUMENTS

| | | | | | |
|---|---|---|---|---|---|
| 4,791,863 | A | * | 12/1988 | Vahatalo | 100/35 |
| 5,047,122 | A | * | 9/1991 | Crouse et al. | 162/206 |
| 5,383,371 | A | * | 1/1995 | Laitinen | 73/862.55 |
| 5,507,916 | A | * | 4/1996 | Schiel | 162/195 |
| 5,592,875 | A | * | 1/1997 | Moschel | 100/99 |
| 5,953,230 | A | * | 9/1999 | Moore | 700/122 |
| 6,070,472 | A | * | 6/2000 | Kipping et al. | 73/829 |
| 6,138,506 | A | * | 10/2000 | Neuschutz et al. | 73/159 |
| 6,352,615 | B1 | * | 3/2002 | Tavi et al. | 162/198 |
| 6,370,961 | B1 | * | 4/2002 | Trantzas et al. | 73/824 |

* cited by examiner

*Primary Examiner*—Steven P. Griffin
*Assistant Examiner*—Eric Hug
(74) *Attorney, Agent, or Firm*—Alix, Yale & Ristas, LLP

(57) ABSTRACT

The invention relates to a process for measuring and controlling the nip pressure in the press of a paper machine, particularly in a shoe press, across and/or along the web running direction. It is largely characterized by the hydraulic, static pressure being measured at reference points through measurement boreholes in the press nip and adjusted continuously. In addition, the invention relates to a device for carrying out the process.

18 Claims, 5 Drawing Sheets

PROCESS AND DEVICE FOR MEASURING AND CONTROLLING THE NIP PRESSURE IN THE PRESS OF A PAPER MACHINE

BACKGROUND OF THE INVENTION

The invention relates to a process for measuring and controlling the nip pressure in the press of a paper machine, particularly in a shoe press, across and/or along the web running direction. In addition, the invention relates to a device for carrying out the process.

In order to control dewatering by presses used in the paper-making sector, the appropriate nip pressure must be set. That is why there are a number of theoretical calculation approaches. These can be applied as long as conditions are ideal. Particularly in the edge zones of a paper web however, for example at the creping cylinder of a tissue machine, non-uniform conditions occur that can no longer be expressed precisely in a calculation. On the other hand, there are also operating parameters that can be calculated, but production realities prevent them from being entered as actual settings.

SUMMARY OF THE INVENTION

The aim of the invention is thus to create a process and a device to measure and control the nip pressure across and/or along a press in order to obtain an even moisture profile or to set paper quality parameters.

The invention is characterised by the hydraulic, static pressure in the press gap (press nip) being measured at reference points through measurement boreholes exposed to the nip. By measuring at reference points, it is very easy to determine the nominal pressure value for controlling the nip pressure in the cross direction and the actual pressure curve in running direction.

An advantageous further development of the invention is characterised by the nip pressure in the press being controlled at this nominal value in cross direction and thus, also being adjusted continuously. With this control method it is possible to obtain uniform press duty across the machine running direction at any production status.

A favourable configuration of the invention is characterised by differential set values for the pressure across the web width. As a result, the moisture profile of the paper web can be influenced selectively.

The invention is also directed to a device for measuring and controlling the nip pressure in the press of a paper machine, particularly in a shoe press, across and/or along the web running direction. It is characterised by measurement boreholes being provided at several points in the press across and/or in web running direction, and which extend into the press nip. By measuring the pressure at the reference points, it is possible to determine the entire pressure progression exactly and control it accordingly.

If measurement boreholes are provided in the edge zone, the areas that cannot be calculated can be controlled particularly well.

If several pressing elements, for example pressing pistons, are provided across the web width and which are of a design that allows them to be controlled partly or entirely, the nip pressure profile or also the moisture profile across the web running direction can be controlled particularly well.

Due to the adjustable shoe limit stop, the position of the press shoe can be moved in longitudinal direction and the longitudinal profile of the nip pressure in the nip thus set and/or controlled.

BRIEF DESCRIPTION OF THE DRAWINGS

The invention will be described using the examples in the drawings, where.

DESCRIPTION OF THE PREFERRED EMBODIMENT

Figure 1:
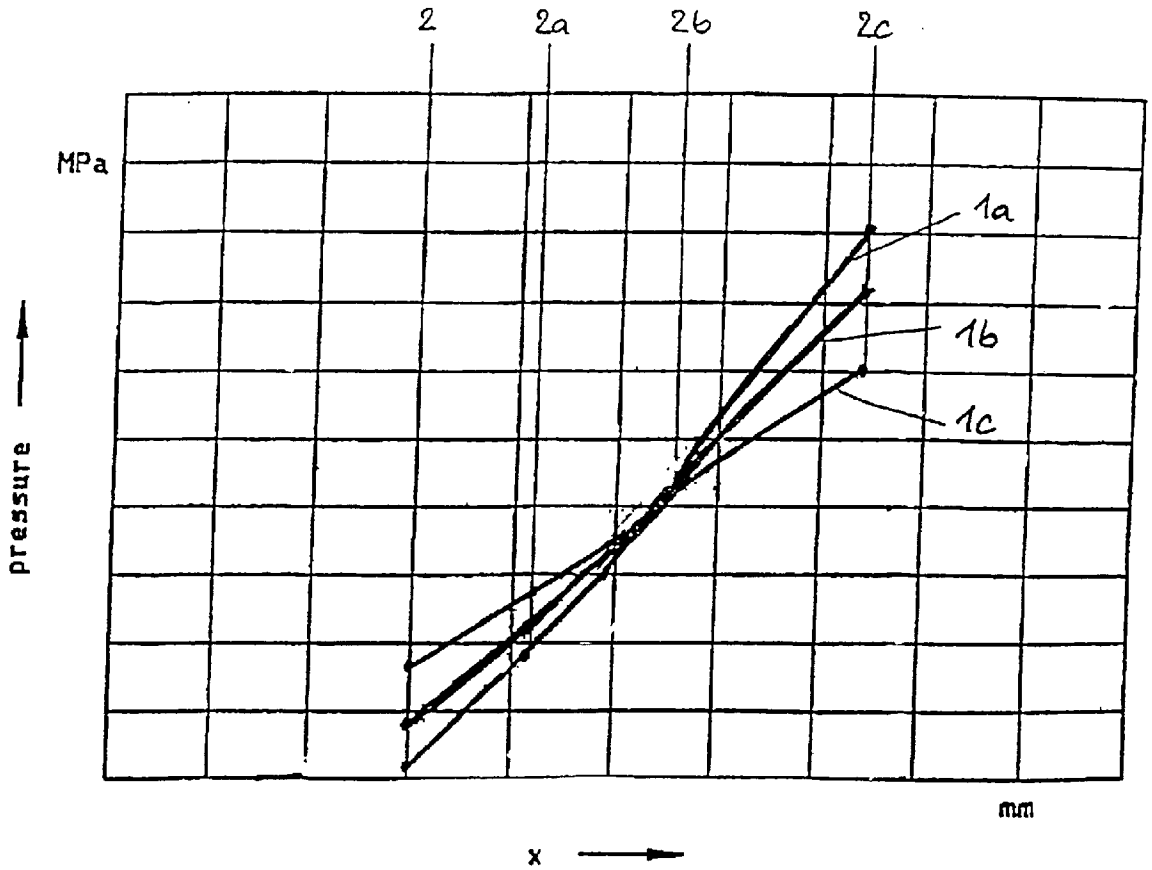
FIG. 1 shows a diagram of the pressure progression in a press.

FIG. 1 shows a progression or profile of the pressing force of a shoe press in the web running direction x. The various curves shown, 1*a*, 1*b*, and 1*c*, refer to different products. In addition, potential locations, 2*a*, 2*b*, and 2*c*, are marked for pressure measuring points in the web running direction. If the pressure measurements at these points are known, the influence this has on the paper grade can be determined and corrected or controlled. An analogous profile can be obtained in the cross-web direction.

Figure 2:
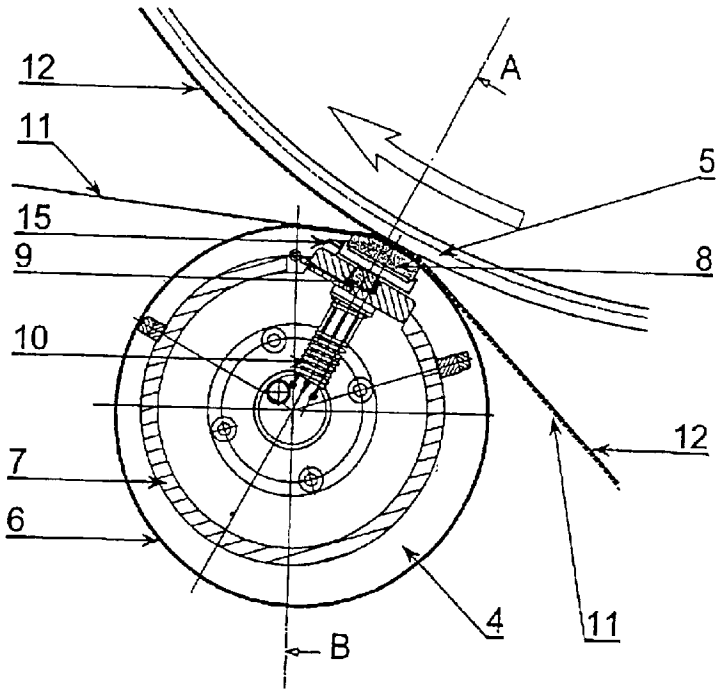
FIG. 2 shows a cross-section through a press roll.

FIG. 2 shows a shoe press roll 4 with a mating roll 5. This mating roll 5 can also be the drying cylinder of a tissue machine. The roll consists of an outer press shell 6 and a supporting ring 7 on which the press shoe 8 rests. The press shoe 8 is loaded against the press shell 6 by pressing elements 9. A return spring 10 is provided as a counterforce and to retrieve the press shoe when pressure is relieved. Due to the pressure generated on the press shell 6 by the press shoe 8, the paper web 12 transported on the felt 11 is pressed against the mating roll 5 and dewatered. The paper web 12 can then be carried onwards together with the mating roll. If this mating roll 5 is the drying cylinder of a tissue machine, this is where the thermal drying process of the paper begins. The more water removed from the web by the press, the higher the drying capacity of the drying cylinder.

In order to control the moisture profile across the web running direction and also compensate edge zone influence, several pressing elements 9 are provided across the web running direction which can be adjusted either individually or partly separated.

The shoe limit stop 15 can be moved in the web running direction in order to exert a targeted influence on the longitudinal profile of the nip pressure and/or on the paper quality.

Figure 3:
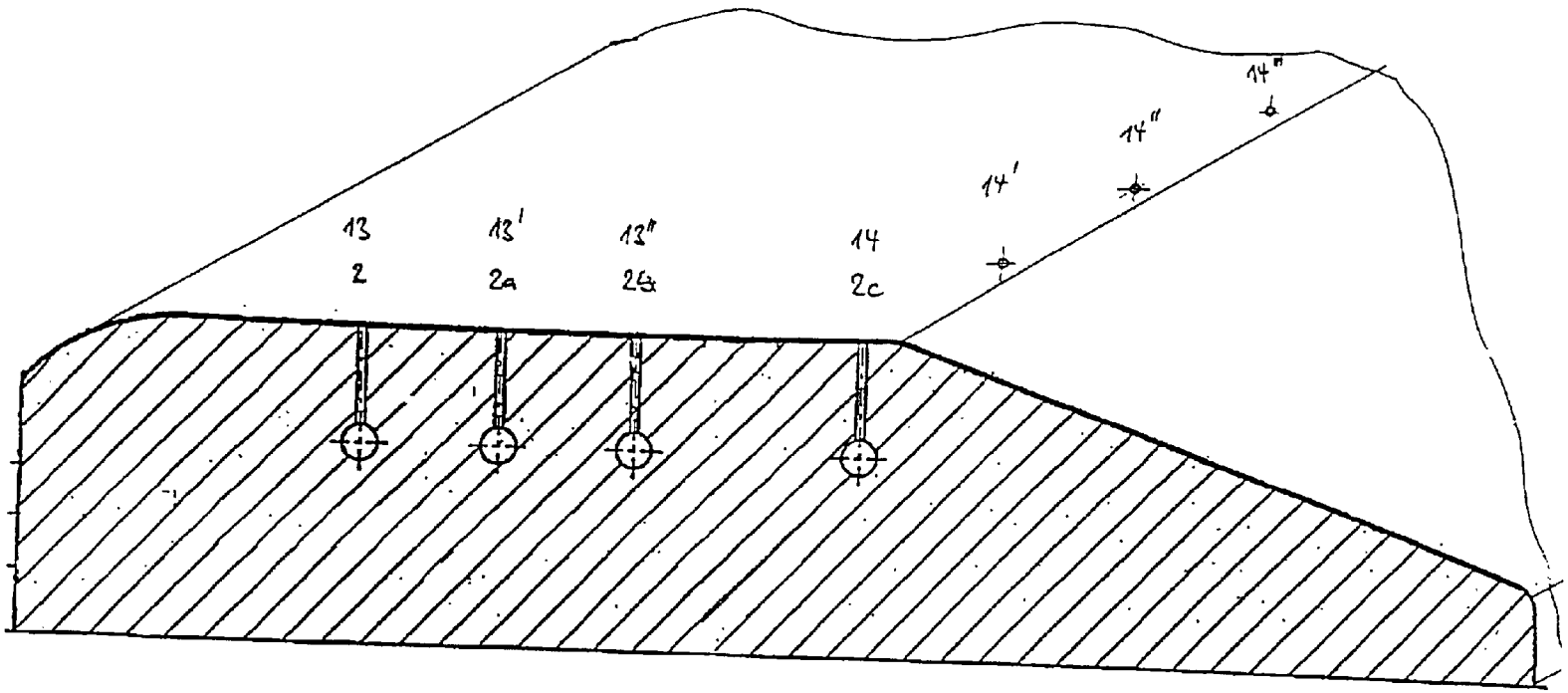
FIG. 3 contains a horizontal projection and cross-section of the press shoe in a shoe press according to the invention.

FIG. 3 contains a horizontal projection of a pressure shoe 8. This figure shows measurement boreholes 13, 13', 13" and 14, 14', 14", 14'". The measurement boreholes 14, 14', 14", 14'" are located across the web running direction, while measurement boreholes 13, 13', and 13" are aligned with borehole 14 in web running direction. These measurement boreholes correspond to measuring points 2, 2*a*, 2*b* and 2*c* in FIG. 1.

Figure 4:
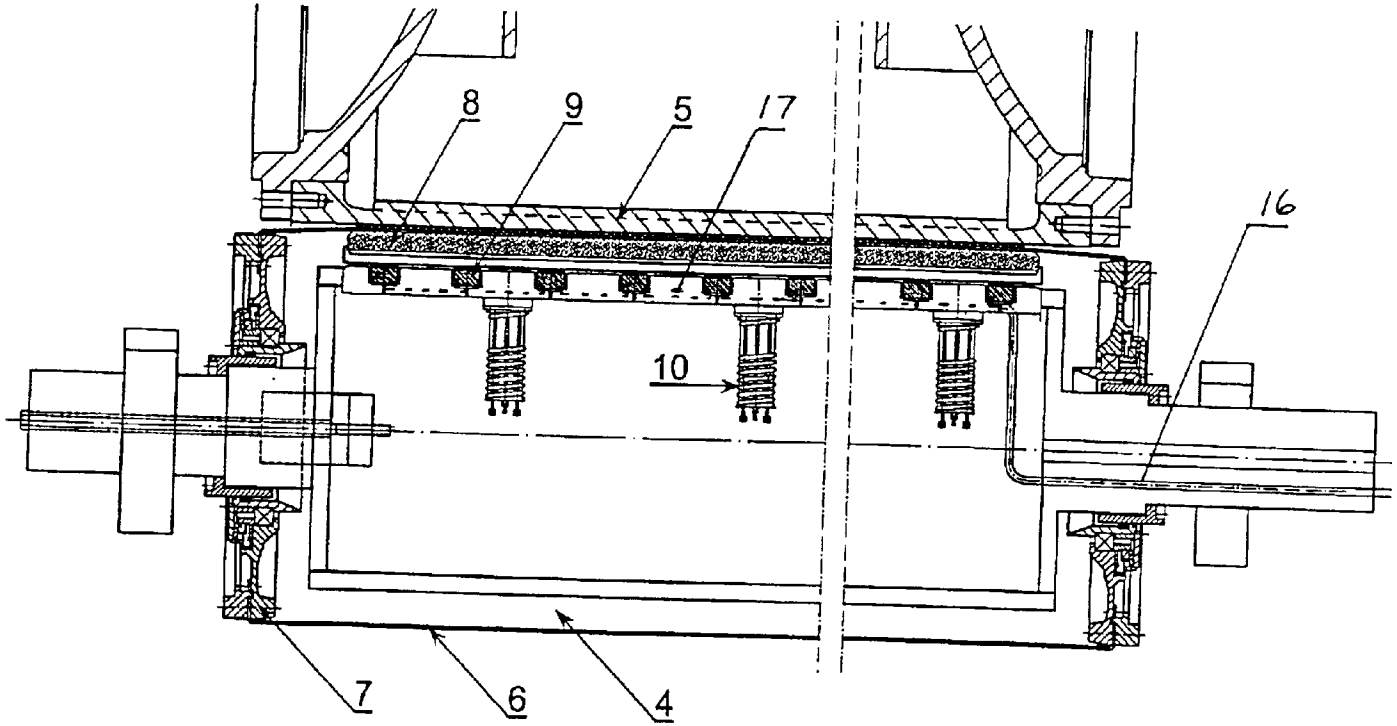
FIG. 4 shows a sectional view along the line marked A–B in FIG. 2.

FIG. 4 shows a sectional view along the line marked A–B in FIG. 2.

Here, the shoe press roll 4 and mating roll 5 are shown. Several pressing elements 9 are provided across the web width for loading the press shoe 8. These can be actuated independently of one another via an oil feed pipe 16 and associated distribution lines 17 (shown in phantom). Pressure is relieved via the return springs 10.

Figure 5:
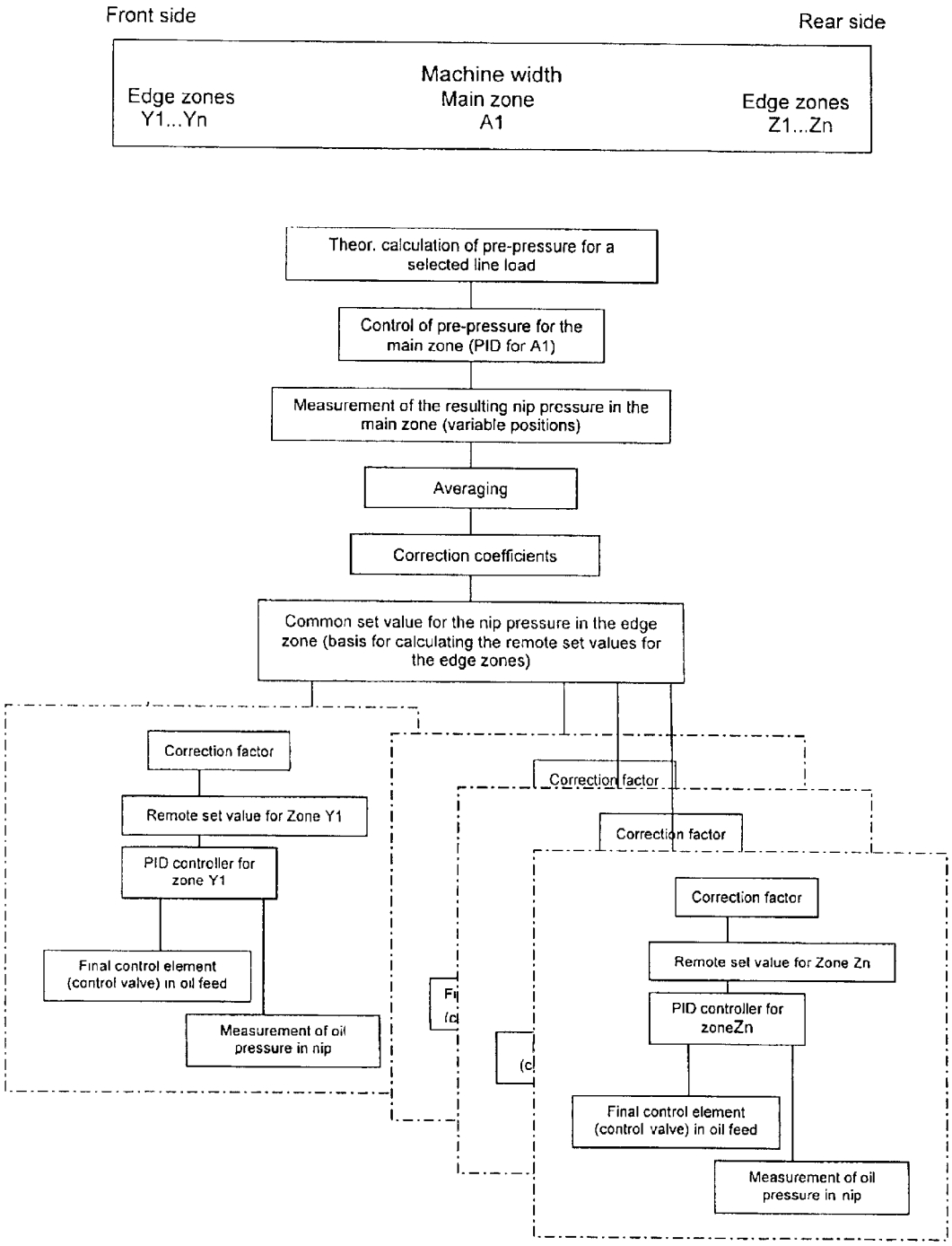
FIG. 5 contains a control diagram for a plant according to the invention.

FIG. 5 contains a control diagram for a plant according to the invention. As a basic principle, the plant is split into zones across the machine width for control purposes. A difference is made between the main zone A1 in the centre of the machine and the edge zones on the front and rear sides (Y1 . . . Yn, Z1 . . . Zn), where the number of edge zones is variable. The pressure in the oil feed pipe to the main zone (pre-pressure controlled by PID controller) is controlled based on the theoretical calculation of the oil pre-pressure for the pressing elements in the main zone required to obtain a selected line load. The operator selects the desired line load in the process control system. The oil pressure in the nip resulting from the pre-pressure control is measured redundantly in the nip of the main zone itself, the values measured are averaged and then used for edge zone control after evaluation with a coefficient of correction as theoretical set value. The measurement in the main zone is taken as the basis for the set values in the edge zones. First a calculation (evaluation) is made according to theoretical formula with the influence of the pressure in the edge zones for the dry content. From this a coefficient of correction with reference to the pressure in the main zone is determined and used as the basis for specific set values for the pressure in the specific edge zones. The theoretical formula includes parameters such as the paper quality, basis weight, and level of dry content.

The position of the pressure measurements for the main zone is also variable. This common edge zone set value is now adjusted again for each individual edge zone according to the operating requirements and fed to the individual PID controllers as remote set value. In this case, each edge zone has its own PID controller, where the final control element is located ahead of the roll in the oil feed pipe to the loading element of the appropriate edge zone and the pressure is measured directly in the nip in the position of the appropriate edge zone.

This control concept provides a facility for the first time to maintain the pressure in the nip itself constant over the entire width and thus, to obtain an even line load in real terms.

What is claimed is:

1. Process for measuring and controlling pressure in a nip between rolls of a paper-web press running through a paper machine, across and/or along the web running direction, comprising continuously measuring the static hydraulic pressure at a plurality of reference points in the nip through a plurality of measurement boreholes spaced apart in the web running direction and exposed to the nip, and controlling the pressure in the nip as a dependent variable in the web running direction in response to the measurements from said measurement boreholes.

2. The process according to claim 1, wherein the nip pressure is controlled at a nominal value across and/or along the web running direction.

3. The process according to claim 2, wherein the measured values of the nip pressure are averaged and then provided with a co-efficient of correction to form a new set value for maintaining said nominal value.

4. The process according to claim 1, wherein the nip has edge zones at the axial ends of the press rolls, with respective measurement boreholes, and the nip pressure in the edge zones is adjusted continuously.

5. The process according to claim 1, wherein a plurality of boreholes are spaced apart across the web running direction for measuring a nip pressure profile across the web, and wherein the pressure profile across the web is controlled in response to the measurements from the boreholes spaced across the web.

6. The process according to claim 5, wherein for a given web to be pressed, the pressure profile in the web running direction and the pressure profile in the cross web direction are assigned nominal values, and wherein the pressure at each measurement location is controlled in response to the respective measurement, at a set value, whereby said pressure profiles are maintained.

7. A process for measuring and controlling pressure in a nip between press rolls in a paper machine, the nip having edge zones at the axial ends of the press rolls including respective measurement boreholes and the nip pressure in the edge zones is adjusted continuously wherein, the nip has a main zone between the edge zones and a plurality of measurement boreholes in the main zone;

the pressure measurements in the main zone are used to compute a set value for the pressure in the edge zones; and the pressure in each edge zone is controlled according to the set value.

8. The process according to claim 7, including precalculating a nominal pressure of the main zone;

measuring the nip pressure at a plurality of boreholes in the main zone and controlling the pressure profile in the main zone in response to said measurements and said precalculated nominal pressure.

9. Device for measuring and controlling pressure in a nip between rolls of a paper web press running through a paper machine, across and/or along the web running direction, wherein the improvement comprises a plurality of measurement boreholes provided at a respective plurality of points in the press and extending into the nip, one of said rolls having a press shoe with a limit stop adjustable in the web running direction, the limit stop being adjustable during operation of the press in response to measurements from said plurality of measurement boreholes.

10. Device for measuring and controlling pressure in a nip between rolls of a paper web press running through a paper machine, across and/or along the web running direction, wherein the improvement comprises a plurality of measurement boreholes provided at a respective plurality of points in the press and extending into the nip, one of said rolls has a press shoe extending across the width of the web, and wherein said boreholes are situated in said shoe and spaced apart in the web running direction.

11. Device according to claim 10, wherein the nip has edge zones at the axial ends of the press rolls, with respective measurement boreholes exposed to the edge zones.

12. Device according to claim 10, wherein a plurality of pressing elements are provided in the press roll, across the web width, each pressing element being controllable independently of the other, in response to measurements of the nip pressure.

13. Device according to claim 10, wherein some of said boreholes in the shoe are spaced apart across the web.

14. Device according to claim 13, including individual pressing elements for differentially acting on the press shoe, spaced apart across the web and individually controllable in response to measurements from said plurality of boreholes.

15. Device for measuring and controlling pressure in a nip between rolls of a paper web press running through a paper machine, across and/or along the web running direction, wherein the improvement comprises a plurality of measurement boreholes provided at a respective plurality of points in the press and extending into the nip, one of said rolls has a press shoe extending across the width of the web, and wherein said boreholes are spaced apart across the web.

16. Device according to claim 15, including individual pressing elements for differentially acting on the press shoe, spaced apart across the web and individually controllable in response to measurements from said plurality of boreholes.

17. Device according to claim 15, wherein the nip has edge zones at the axial ends of the press rolls, with respective measurement boreholes exposed to the edge zones.

18. Device according to claim 15, wherein a plurality of pressing elements are provided in the press roll, across the web width, each pressing element being controllable independently of the other, in response to measurements of the nip pressure.

* * * * *